US011547898B2

(12) United States Patent
Netter et al.

(10) Patent No.: US 11,547,898 B2
(45) **Date of Patent: *Jan. 10, 2023**

(54) SEATED TREADMILL AND METHOD OF USE

(71) Applicant: ONTHEMUV, INC., Los Altos, CA (US)

(72) Inventors: Jean Patrick Netter, Malibu, CA (US); David L. Medin, Los Altos, CA (US)

(73) Assignee: ONTHEMUV, INC., Malibu, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/541,018

(22) Filed: Aug. 14, 2019

(65) Prior Publication Data

US 2019/0366151 A1 Dec. 5, 2019

Related U.S. Application Data

(63) Continuation of application No. 15/794,588, filed on Oct. 26, 2017, now Pat. No. 10,603,538.
(Continued)

(51) Int. Cl.
*A63B 22/02* (2006.01)
*A63B 22/00* (2006.01)
(Continued)

(52) U.S. Cl.
CPC ..... *A63B 22/02* (2013.01); *A63B 22/0023* (2013.01); *A63B 22/0235* (2013.01);
(Continued)

(58) Field of Classification Search
CPC ... A63B 22/02; A63B 22/002; A63B 22/0694; A63B 22/0235; A63B 21/00181;
(Continued)

(56) References Cited

U.S. PATENT DOCUMENTS 3,642,279 A * 2/1972 Cutter ..... A63B 22/02 482/54
4,743,008 A * 5/1988 Fermaglich ..... A63B 69/0064 297/137
(Continued)

FOREIGN PATENT DOCUMENTS

| | | |
|---|---|---|
| CN | 2717301 | 8/2005 |
| CN | 205516185 U | 8/2016 |
| KR | 20110104580 | 9/2011 |

OTHER PUBLICATIONS

Extended European Search Report in European Application No. 17883039, dated Jun. 9, 2020, 3 pages.

*Primary Examiner* — Garrett K Atkinson
*Assistant Examiner* — Kathleen M Fisk
(74) *Attorney, Agent, or Firm* — Procopio, Cory, Hargreaves & Savitch LLP

(57) ABSTRACT

A seated treadmill has a structure with a front portion and a rear portion. A front roller is rotatably mounted on the front portion of the structure, a rear roller is rotatably mounted on the rear portion of the structure, and a belt circumscribes the front and rear rollers. The front and rear rollers are much closer together than prior art treadmills, typically about 10-30 inches. The treadmill may further include a remote control for controlling operation of the treadmill, and a shutoff switch in the event that too much force is placed upon the treadmill, such as if the user attempts to stand on the treadmill.

15 Claims, 8 Drawing Sheets

Related U.S. Application Data

(60) Provisional application No. 62/438,339, filed on Dec. 22, 2016.

(51) Int. Cl.

| | |
|---|---|
| ***A63B 22/06*** | (2006.01) |
| ***A63B 71/00*** | (2006.01) |
| *A63B 71/06* | (2006.01) |
| *A63B 21/00* | (2006.01) |

(52) U.S. Cl.

CPC .... *A63B 22/0694* (2013.01); *A63B 21/00181* (2013.01); *A63B 2022/0094* (2013.01); *A63B 2071/0081* (2013.01); *A63B 2071/068* (2013.01); *A63B 2071/0683* (2013.01); *A63B 2208/0228* (2013.01); *A63B 2208/0233* (2013.01); *A63B 2220/17* (2013.01); *A63B 2220/51* (2013.01); *A63B 2220/52* (2013.01); *A63B 2220/54* (2013.01); *A63B 2225/20* (2013.01); *A63B 2230/06* (2013.01)

(58) Field of Classification Search

CPC ..... A63B 2220/51; A63B 2220/17; A63B 2220/54; A63B 2220/52; A63B 2071/068; A63B 2071/0683; A63B 2071/0081; A63B 2225/20; A63B 2208/0228; A63B 2210/02; A63B 24/00–2024/0096; A47B 2220/06; B65G 2811/093; B65G 43/00; B65G 43/02; B65G 43/08

See application file for complete search history.

(56) References Cited

U.S. PATENT DOCUMENTS

| | | | | | |
|---|---|---|---|---|---|
| 4,861,021 | A | | 8/1989 | Edwards et al. | |
| 4,869,493 | A | * | 9/1989 | Johnston | A63B 22/0002 482/54 |
| 5,368,532 | A | | 11/1994 | Farnet | |
| 5,437,588 | A | * | 8/1995 | Abboudi | A63B 22/02 482/139 |
| 5,688,209 | A | * | 11/1997 | Trulaske | A63B 22/0012 482/54 |
| 6,224,516 | B1 | * | 5/2001 | Disch | A63B 22/02 482/51 |
| 6,761,667 | B1 | * | 7/2004 | Cutler | A63B 22/0023 482/51 |
| 7,052,441 | B2 | | 5/2006 | Sankrithi | |
| 7,674,206 | B2 | * | 3/2010 | Jones | A61H 1/0255 482/51 |
| 7,914,420 | B2 | | 3/2011 | Daly et al. | |
| 8,241,187 | B2 | * | 8/2012 | Moon | A63B 22/0005 482/54 |
| 8,333,681 | B2 | * | 12/2012 | Schmidt | A63B 21/012 482/4 |
| 8,608,624 | B2 | * | 12/2013 | Shabodyash | A61H 11/00 482/51 |
| 8,986,176 | B2 | | 3/2015 | Arst | |
| 9,084,911 | B2 | | 7/2015 | Hsu | |
| 9,511,254 | B2 | | 12/2016 | Netter et al. | |
| 10,328,303 | B2 | | 6/2019 | Frank | |
| 10,603,538 | B2 | * | 3/2020 | Netter | A63B 22/0235 |
| 2002/0045517 | A1 | | 4/2002 | Oglesby et al. | |
| 2003/0153438 | A1 | | 8/2003 | Gordon et al. | |
| 2004/0005961 | A1 | * | 1/2004 | Iund | A63B 22/0023 482/54 |
| 2006/0009332 | A1 | * | 1/2006 | Jones | A61H 1/0255 482/54 |
| 2006/0052728 | A1 | | 3/2006 | Kerrigan et al. | |
| 2007/0004562 | A1 | * | 1/2007 | Pan | A63B 24/00 482/54 |
| 2008/0194389 | A1 | * | 8/2008 | Southerland | A63H 33/006 482/54 |
| 2012/0264573 | A1 | * | 10/2012 | Hsu | A63B 22/0235 482/54 |
| 2015/0209611 | A1 | * | 7/2015 | Arst | A63B 22/02 482/54 |
| 2015/0251047 | A1 | * | 9/2015 | Maaniitty | A47B 21/02 482/54 |
| 2015/0351553 | A1 | | 12/2015 | Herring et al. | |
| 2016/0263429 | A1 | | 9/2016 | Wagner | |
| 2016/0354669 | A1 | | 12/2016 | Rozenberg | |
| 2018/0178055 | A1 | | 6/2018 | Netter et al. | |
| 2020/0179748 | A1 | | 6/2020 | Netter et al. | |

* cited by examiner

SEATED TREADMILL AND METHOD OF USE

CROSS-REFERENCE TO RELATED APPLICATIONS

This application is a continuation of U.S. patent application Ser. No. 15/794,588, filed Oct. 26, 2017, entitled "SEATED TREADMILL AND METHOD OF USE," which claims priority to U.S. Provisional Application No. 62/438,339, filed Dec. 22, 2016, the contents of both of which are hereby incorporated by reference in their entireties.

BACKGROUND OF THE INVENTION

Field of the Invention

This invention relates generally to treadmills, and more particularly to a treadmill adapted to be used while seated.

Description of Related Art

Traditional cardiovascular exercise equipment such as treadmills, ellipticals, rowers and stationary cycles, require users to have enough self-sufficiency and balance to support the majority of their own weight while exercising. The user must also have a dedicated area in which to exercise to receive the large equipment. This is impractical or impossible for a significant portion of the population.

The following groups of people are normally precluded from using the aforementioned equipment due to mainly physical and supervisorial limitations.

DISABLED: Individuals who have poor balance (Parkinson's, neurological disorders, etc.), who suffer neuropathy due to diabetes, are blind, or are morbidly obese, etc.

PHYSICAL REHAB: Individuals recovering from hip, back, or knee surgery, and cannot put their full body weight onto their legs while exercising.

ELDERLY: Individuals who are severely deconditioned, feeble, or who otherwise require constant supervision.

WORKPLACE: Most work environments require sitting at a desk for 4-8 hours or more and don't allow for exercise while at work.

The present invention provides cardiovascular and lower body exercise while seated in a comfortable and safe environment, usually a chair or couch. This enables all of the aforementioned groups of individuals to get a cardiovascular workout in a more secure, safe and easy to navigate fashion.

The prior art teaches a wide range of treadmills, almost all of which are adapted for use in a standing position (i.e., for walking, running, etc.). An example of such a treadmill is shown in Farnet, U.S. Pat. No. 5,368,532, which teaches a motorized treadmill with an endless belt around rollers. The treadmill includes a front post that supports a front housing that includes handrails for facilitating running on the belt. The front housing includes controls for controlling the operation of the motor, and also provides the handrails that assist the user with maintaining his or her balance. None of these front housing structures are included in the present invention.

There are a few specialty treadmills shown in the prior art that are adapted for use in a seated position. Examples include the following:

Hsu, U.S. Pat. No. 9,084,911, teaches a fairly standard treadmill that further includes a chair mounted over the belt of the treadmill. While this shows the general concept of using a treadmill from a seated position, it is structurally different from the present invention. The Hsu treadmill is sized and shaped like a standard treadmill (i.e., the belt has a length of 4-5 ft.), and includes a standard front housing construction.

Netter, U.S. Pat. No. 9,511,254, teaches a treadmill may be used from either a standing or seated position, and may be used in conjunction with a desk. This treadmill has a belt that is 38 inches long, so it is shorter than other standing treadmills, but it is still significantly longer than the present invention. Furthermore, while this treadmill is separable from the upright components (in this case, in the form of the desk), it does still include a front housing which has engagement elements for interlocking with the desk structure. Importantly, the present invention eliminates this front housing entirely.

Maaniitty, U.S. 2015/0251047, teaches a treadmill used in conjunction with a desk and an office chair. A similar construction is also shown in Herring, U.S. 2015/0351553. Abboudi, U.S. Pat. No. 5,437,588, teaches a treadmill for use within a pool of water for therapeutic exercise that includes an endless track mounted between a pair of side members, a hand rail spaced above and extending parallel to one of the side members, and a vertical post secured to the one side member and providing support for the handrail. A seating member is mounted on the vertical post and is movable with respect to the post for selectively disposing the seating member at various heights above the one side member and either directly overlying the endless track or disposed to one side thereof.

The prior art teaches a variety of treadmills, some of which may be used in a seated position. However, all of the prior art treadmills are adapted for typical treadmill operation, in which the user is walking or running on the treadmill. The prior art does not teach a treadmill wherein the front and rear rollers are separated by a longitudinal distance that is only 10-30 inches, which is not long enough for this typical treadmill operation, but is used for a new process of seated stepping, wherein the user does not stand upon the treadmill, but moves his or her feet on the treadmill from a seated position. The present invention fulfills these needs and provides further advantages as described in the following summary.

SUMMARY OF THE INVENTION

The present invention teaches certain benefits in construction and use which give rise to the objectives described below.

The present invention provides a treadmill adapted to be used in a seated position. The treadmill includes a structure having a front portion and a rear portion; a front roller rotatably mounted on the front portion of the structure; and a rear roller rotatably mounted on the rear portion of the structure such that the rear roller is disposed parallel to the front roller and spaced apart from the front roller by a longitudinal distance that is between 10-30 inches. The treadmill further includes a belt mounted around the front and rear rollers. The spacing of the rollers results in a flat belt length that is between 10-30 inches. A primary objective of the present invention is to provide a treadmill having advantages not taught by the prior art.

Another objective is to provide a treadmill that is uniquely short, having front and rear rollers that are separated by a longitudinal distance such that the flat belt length is only 10-30 inches, a length that is not suitable for typical walking/running treadmill operation, but which enables a new form of seated stepping that is unique to the present invention.

Another objective is to provide a treadmill that lacks a front housing, so that there is no front structure that connects the side frames in front of the front roller.

Another objective is to provide a treadmill that may be controlled by a remote control.

Another objective is to provide a treadmill that automatically shuts off in the event that the user stands upon the treadmill.

Another objective is to enable tread belt materials with increased elasticity, compressibility, and thickness to improve comfort and usability for a seated user that may not be wearing running shoes.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a treadmill that is adapted to be used from a seated position. The treadmill is dramatically shorter than prior art treadmills, and is adapted to be used at a desk while seated, at home while seated during rehabilitation, by the elderly while seated and in other non-traditional manners. The treadmill may be used by persons who are have difficulty walking, and the treadmill may be used barefoot, or wearing socks, or other footwear that is not necessarily suitable for running.

Figure 1:
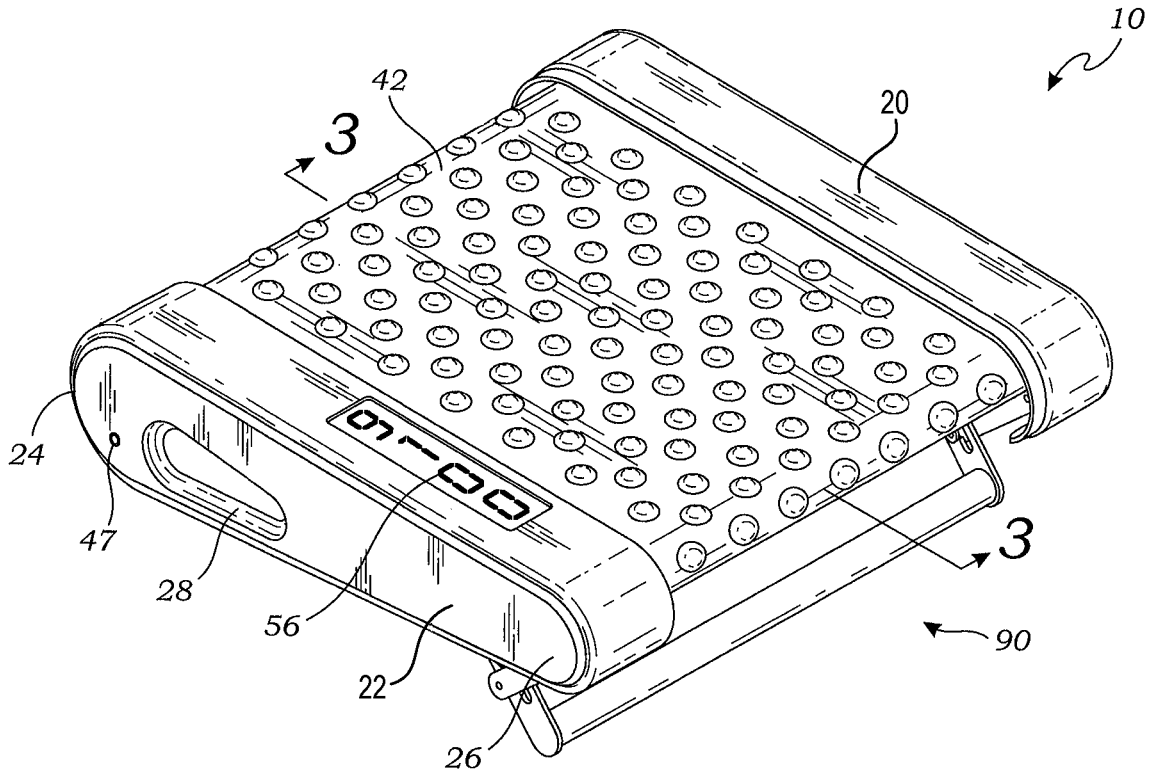
FIG. 1 is a perspective view of a treadmill according to one embodiment of the present invention.
Figure 3:
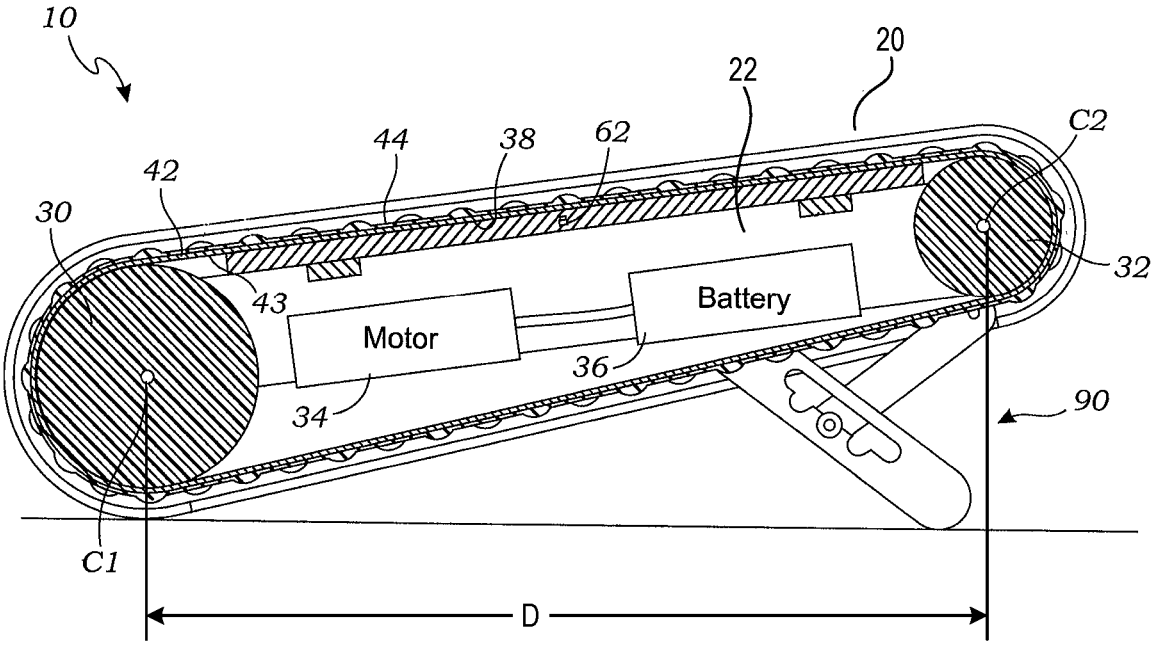
FIG. 3 is a sectional view thereof taken along line 3-3 in FIG. 1.

FIG. 1 is a perspective view of a treadmill 10 according to one embodiment of the present invention. As shown in FIG. 1, the treadmill 10 includes a structure 20 for supporting the other elements of the treadmill 10, as described below. In this embodiment, the structure 20 includes a pair of side structures 22, each having a front portion 24 and a rear portion 26. In one embodiment, the structure 20 notably lacks any front structure that connects the side structures 22 in front of the front roller 30. Further details of this structure 20 are shown in FIG. 3, as discussed in greater detail below. While one embodiment of the structure 20 is illustrated and discussed in detail, those skilled in the art may devise other embodiments of the structure 20 for supporting the treadmill 10, and such alternative constructions should be considered within the scope of the present invention.

The treadmill 10 further includes a belt 42 upon which the user places his or her feet. The structure 20 supports front and rear rollers (elements 30 and 32, shown in FIG. 3), which support the belt 42. The structure 20 may further include various alternative elements, such as a display 56 for displaying information regarding the usage of the treadmill 10 (e.g., steps taken, distance traversed, heart rate of user, battery life, etc.). The treadmill 10 may include a recharging port 47, and an adjustable support structure 90. All of these features, and more, are discussed in greater detail below.

As shown in FIG. 1, the structure 20 may be in the form of a frame on either side of the belt 42, and the structure 20 further includes a recess 28 that provides a handle that facilitates lifting the treadmill 10.

Figure 2:
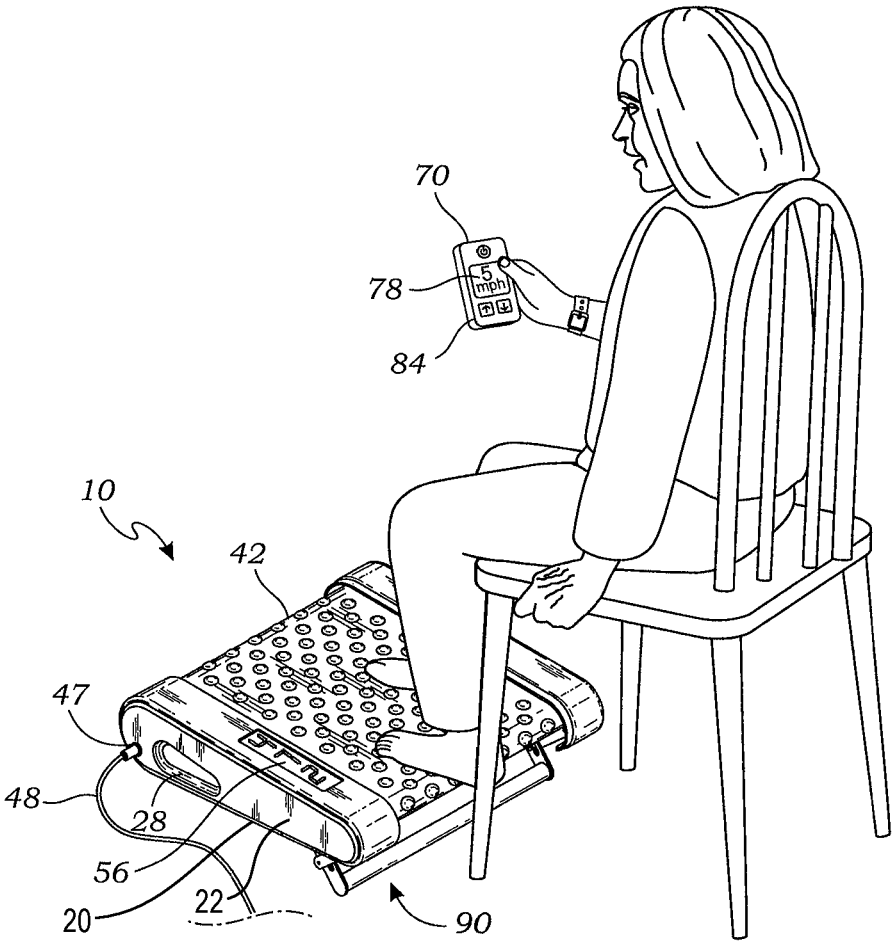
FIG. 2 is a perspective view of a user using the treadmill from a seated position.

FIG. 2 is a perspective view of a user using the treadmill 10 from a seated position. As shown in FIG. 2, the notably short length of this treadmill 10 enables unique usage of the treadmill 10. While prior art treadmills are meant to be walked and run upon, necessitating a much greater size and strength, this treadmill 10 is not used in a standing position, but only from a seated position. Control of the treadmill 10 may be provided by a remote control 70, or other similar mechanisms (e.g., voice control, and other forms of wireless or remote control 70). As noted above, there is no front housing, so that there is no front structure that connects the side structures 22 in front of the front roller 30. Ordinarily, control mechanisms for the treadmills are located on some form of front structure, and these prior art methods are not possible in this case, since there is no front structure in the current embodiment of the treadmill 10.

A charging mechanism such as a power cord 48 may be provided to operably engage the charging port 47. While one charging mechanism is illustrated, any form of charging may be used (e.g., wireless induction charging, or any other method known in the art). Since the batteries, charging components, etc., are not novel, they are not described in greater detail herein.

FIG. 3 is a sectional view thereof taken along line 3-3 in FIG. 1. As shown in FIG. 3, a front roller 30 is rotatably mounted on the front portions 24 of the side frames 22; and a rear roller 32 is rotatably mounted on the rear portions 26 of the side frames 22. The rear roller 32 is disposed parallel to the front roller 30 and spaced apart from the front roller 30 by a longitudinal distance D. The longitudinal distance D is the distance from the center axis C1 of the front roller 30, to the center axis C2 of the rear roller 32. In this embodiment, the front and rear rollers 30, 32 are separated by a longitudinal distance D that is about 10-30 inches. In one embodiment, the longitudinal distance D is 14-28 inches. For purposes of this application, the term "about" is defined to mean +/−10%. The spacing of the rollers 30 and 32 results in a flat belt length (i.e., the length of the belt 42 from above the center axis C1 to above the center axis C2) that is between 10-30 inches.

In this embodiment, the front roller 30 is somewhat larger in diameter than the rear roller 32; however, this is not required, and in alternative embodiments, alternative configurations may be used.

In the embodiment of FIG. 3, an electric motor 34 is mounted on the structure 20 (directly or indirectly) and operably connected to the front roller 30 for turning the front roller 30. The electric motor 34 is operably connected with a battery 36 (or other power source) for powering the electric motor 34. In this embodiment, the motor 34 is mounted beneath a bed 38 and between the front and rear rollers 30 and 32. This preferred placement enables the treadmill 10 to have no structure in front of the front roller 30, a structure that is provided in prior art treadmills. The removal of this front structure enables use of the treadmill 10 despite the extremely short longitudinal length of the treadmill 10. In an alternative embodiment, the motor 34 may be located within one of the rollers (aka, a "moller"), such as the front roller 30. The battery 36 may be omitted if the motor 34 is directly plugged into a power source, such as an AC socket of a home or other structure.

In the embodiment of FIG. 3, the structure 20 supports the bed 38 positioned between the front roller 30 and the rear roller 32. In this embodiment, lateral support members (e.g., ribs, etc.) extend from the structure 20 (in this case, the side frames 22) to support the bed 38. The belt 42 circumscribes the front roller 30, the bed 38, and the rear roller 32, so that the bed 38 supports the belt 42 during operation of the treadmill 10. The bed 38 is shaped and adapted so that the belt 42 can slide over the bed 38 during use, and may include a low-friction coating or top layer (not shown) to facilitate movement of the belt 42 over the bed 38). Since the general construction of the bed 38 is known, it is not described herein in greater detail. In some embodiments, the bed 38 may be replaced with alternative structures known in the art, or may be omitted.

In the embodiment of FIG. 3, the belt 42 includes an inner layer 43 that is strong and inelastic (e.g., fiber), and an outer layer 44 that is soft and resilient (e.g., rubber, soft plastic, etc.). The outer layer 44 may include resilient protrusions (also shown in FIG. 1) which provide a comfortable surface which enables the user to use the treadmill 10 while barefoot.

In this embodiment, a force sensor 62 is operably positioned to sense force applied from the belt 42 to the bed 38. In one embodiment, the force sensor 62 is used to detect if too much force is applied to the belt 42, such as if the user stands upon the belt 42. Since standing on the treadmill 10 is not encouraged when using some embodiments of the treadmill 10, the force sensor 62 may operate to disabling the motor 34 (i.e., stopping the motor, disconnecting the motor from the rollers, or otherwise ceasing the movement of the rollers by the motor, etc.) to prevent the user from being inadvertently injured from misuse of the treadmill 10. The use of the force sensor 62 is discussed in greater detail below. In another embodiment, the motor 34 may be selected to have an amperage (i.e., horsepower) that is sufficient to move the belt 42 up to a certain weight (e.g., 20 lbs or higher, or potentially a higher threshold, such as 100 lbs, according to the determination of one skilled in the art), but not beyond this threshold. In this manner, if the user stands upon the treadmill 10, it will stop by virtue of the motor 34 selected, because the motor 34 will not be strong enough to move the belt 42 with the weight of the user upon the treadmill 10.

Figure 4:
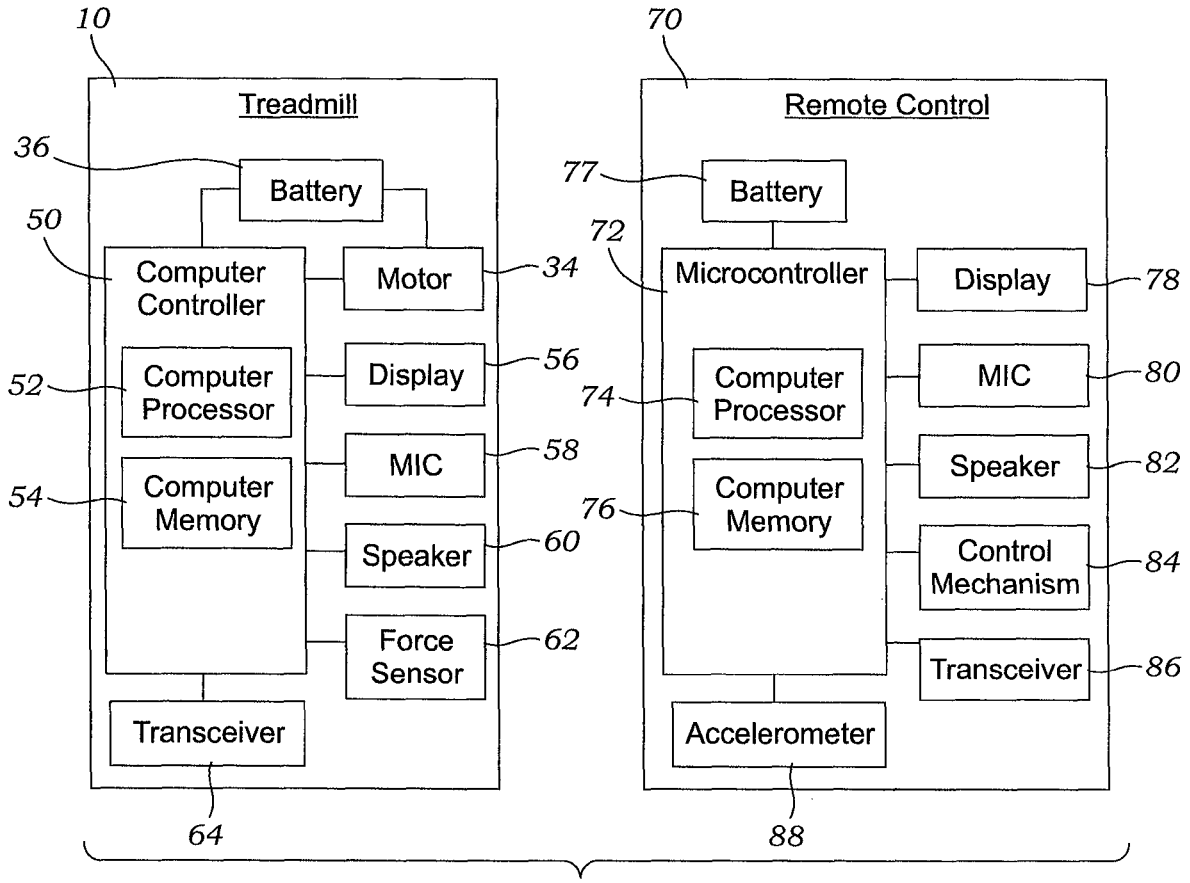
FIG. 4 is a block diagram of the treadmill.

FIG. 4 is a block diagram of the treadmill 10. As shown in FIG. 4, the treadmill 10 may include a computer controller 50 for controlling the electric motor 34 and the operation of the treadmill 10. The computer controller 50 may include a computer processor 52, a computer memory 54, and other electronics known in the art for providing such control, and is operably connected to both the electric motor 34 and the battery 36 or other power source. Since the electronics involved is generally well known in the art, it is not described in greater detail.

The computer controller 50 may be used to control the display 56 (e.g., monitor, LCD screen, any form of display known in the art) for displaying information of interest to the user (e.g., steps taken, distance traversed, heart rate of user, etc.), and/or other information, such as instructions, battery life, etc. While one embodiment of the display 56 is illustrated, it may have any size, shape, or configuration desired by one skilled in the art.

The computer controller 50 may also be operatively connected with a microphone 58 for receiving verbal commands, a speaker 60 for providing audible instructions and other feedback, and a transceiver 64 for transmitting and/or receiving information and commands.

For purposes of this application, the term "transceiver" is defined to include any form of transmitting and/or receiver for communicating, via wired or wireless communication, between the computer controller 50 and an outside device, such as a remote control 70 discussed below.

In this embodiment, the computer controller 50 is operably connected with the force sensor 62 to disable the electric motor 34 if the force applied to the bed 38 exceeds a predetermined maximum weight, and indicates that a user is standing on the treadmill 10 rather than operating it from a seated position. For example, in one embodiment, the electric motor 34 may be disabled if the force exceeds 100 lbs. Those skilled in the art may utilize alternative weights, so long as they are indicative of the incorrect usage of the treadmill 10, and not consistent with the correct usage of the treadmill 10.

As shown in FIG. 4, the treadmill 10 may further include a remote control 70 for remotely controlling the operation of the treadmill 10. In this embodiment, the remote control 70 includes a microcontroller 72 (which includes a computer processor 74 and a computer memory 76) which is operatively connected with a battery 77, and which operatively controls a display 78, a microphone 80, a speaker 82, and a control mechanism 84 for operably controlling the operation of the electric motor of the treadmill 10. For purposes of this application, the term "microcontroller" is defined to include any form of microcontroller, circuit, computer, or other electronics known in the art for performing the functions described herein. The term "control mechanism" is defined to include any form of controls that may be used to control the operation of the treadmill 10 (e.g., buttons, levers, knobs, touch screens, voice actuation, other mechanisms known in the art, etc.).

The remote control 70 may further include a battery 77, a transceiver 86 for communicating with the computer control 50, and an accelerometer 88 for tracking movement of the remote control 70, so that the remote control 70 may be used to control the treadmill 10 via movements of the remote control 70.

In the embodiment of FIG. 2, the remote control 70 is a mechanical device that is particularly designed for the treadmill 10. In alternative embodiments, the remote control 70 may be in another form, such as a smartphone, or other suitable electronic device known in the art.

Figure 5:
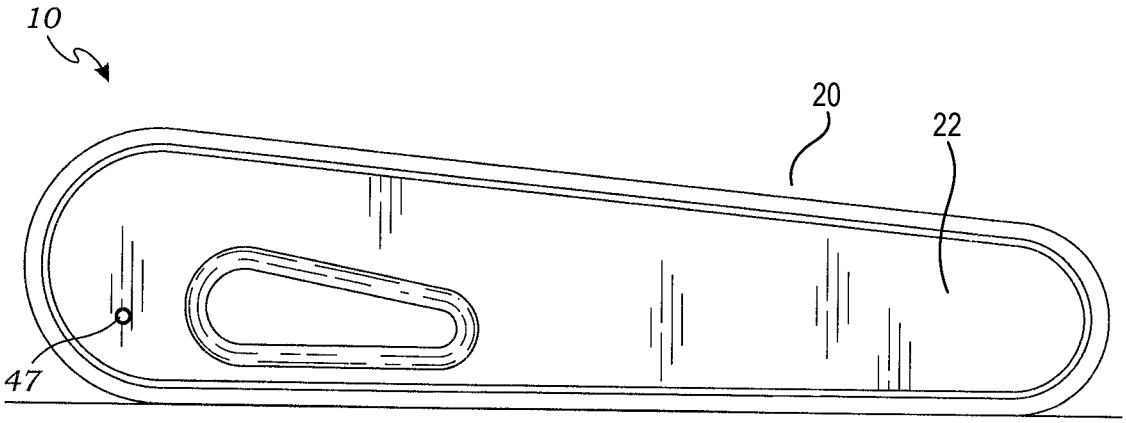
FIG. 5 is a side elevational view of the treadmill in a lowered position.
Figure 6:
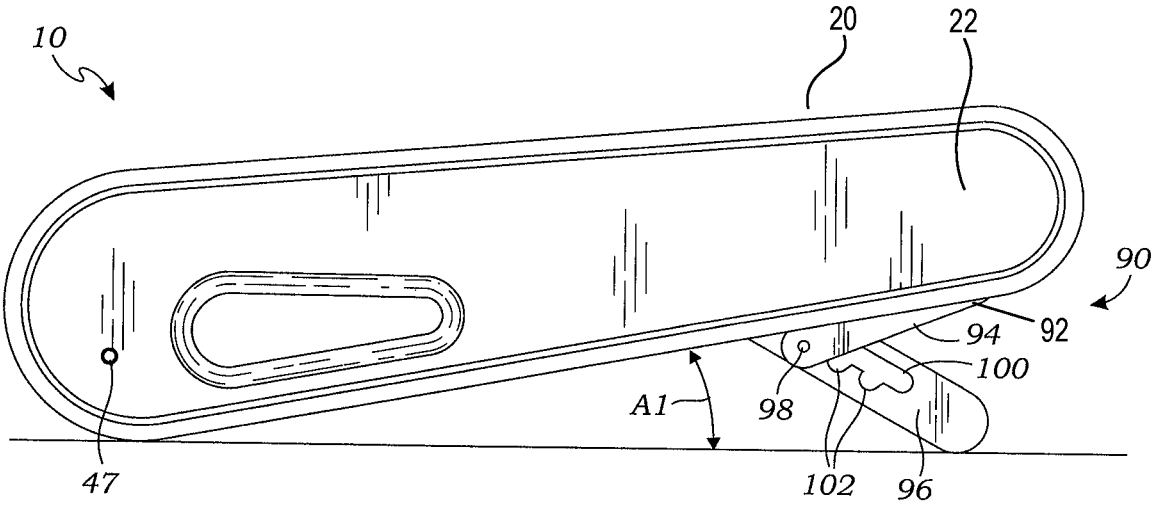
FIG. 6 is a side elevational view of the treadmill in a first raised position.
Figure 7:
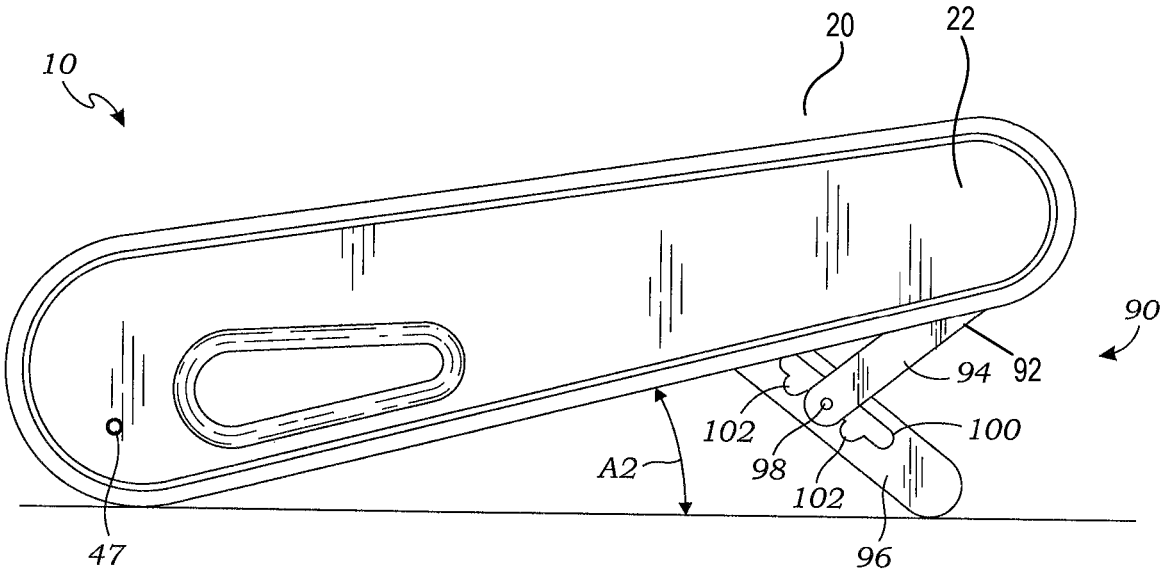
FIG. 7 is a side elevational view of the treadmill in a second raised position.

FIG. 5 is a side elevational view of the treadmill 10 in a lowered position. FIG. 6 is a side elevational view of the treadmill 10 in a first raised position. FIG. 7 is a side elevational view of the treadmill 10 in a second raised position. As shown in FIGS. 5-7, the treadmill 10 further includes an adjustable support structure 90 that may be used to raise and lower the treadmill 10, and adjust the angle of the treadmill 10. FIG. 5 illustrates the treadmill 10 in the lowered position, wherein the adjustable support structure 90 is collapsed, and the treadmill 10 rests flat on the ground.

FIG. 6 illustrates the treadmill once it has been raised to a first angle A1 via the adjustable support structure 90. FIG. 7 illustrates the treadmill once it has been raised to a second angle A2 via the adjustable support structure 90. As shown in FIGS. 6 and 7, the adjustable support structure 90 includes a pair of supports 92, each which may include a first leg 94 and a second leg 96 each pivotally attached to the structure 20 (or other intermediary structure). The first leg 94 includes a post 98 which engages an adjustment slot 100 which includes a plurality of receivers 102. By changing which of the receivers 102 into which the post 98 is engaged, the user is able to adjust the angle of the treadmill 10. While one embodiment of the adjustable support structure 90 is illustrated, those skilled in the art may devise alternative structures for adjusting the angle of the treadmill 10. In one alternative embodiment, the adjustable support structure 90 may be a motorized structure which may be adjusted via computer control, such as the remote control 70 shown in FIGS. 2 and 4. Those skilled in the art may design a wide range of mechanisms and structures that serve to adjust the angle of the bed 38 (shown in FIG. 3), for adjusting the exercises performed on the treadmill 10, and such alternatives should be considered within the scope of the present invention. An alternative location of the adjustable leg structure 90 is further illustrated in FIG. 8, as discussed below.

Figure 8:
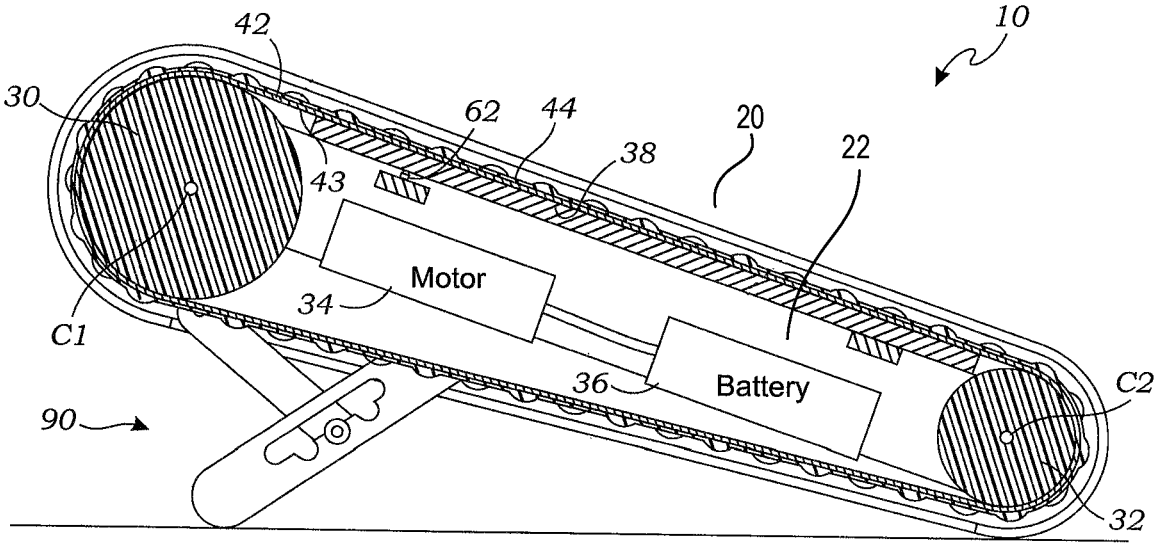
FIG. 8 is a sectional view similar to FIG. 3, illustrating another embodiment of the treadmill.

FIG. 8 is a sectional view similar to FIG. 3, illustrating another embodiment of the treadmill. As shown in FIG. 8, the adjustable support structure 90 may alternatively be located at the front end of the treadmill 10, adjacent the front roller 30. Also, in this embodiment, the force sensor 62 may be located below the bed 38. While this Figure illustrates another configuration within the scope of the present invention, the invention should not be limited to the embodiments specifically illustrated. The adjustable support structure 90 may include any form of adjustment mechanism known in the art, and the force sensor 62 my include any form of sensor known in the art for sensing force, torque, or other measurement that is equivalent, and may be located in any location deemed suitable by one skilled in the art. The force sensor may, for example, determine resistance increases placed on one or both of the rollers, etc.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A treadmill, the treadmill comprising:

a structure for operation by a user in a seated position having:

a pair of side structures, each having a front portion and a rear portion, wherein the front portion of the pair of side structures has a first height that is greater than a second height of the rear portion of the pair of side structures;

a front roller rotatably mounted on the front portion of the pair of side structures;

a rear roller rotatably mounted on the rear portion of the pair of side structures such that the rear roller is disposed parallel to the front roller and is spaced apart from the front roller by a longitudinal distance that is 10 inches or greater, but less than 30 inches;

a belt mounted around the front and rear rollers;

wherein a diameter of the front roller is larger than a diameter of the rear roller; and wherein the treadmill is configured to be positioned on a ground surface in front of the user while the user is seated in a chair such that the user is capable of walking their feet on the treadmill while remaining seated.

2. The treadmill of claim 1, further comprising a bed between the front roller and the rear roller, and a force sensor operably positioned to sense a force applied to the bed.

3. The treadmill of claim 2, further comprising a computer controller for controlling an electric motor of the treadmill, the computer controller being operably connected with the force sensor to disable the electric motor if the force applied to the bed exceeds a predetermined maximum weight, and indicates that the user is standing on the treadmill rather than operating the treadmill in the seated position.

4. The treadmill of claim 3, wherein the electric motor is mounted beneath the bed between the front roller and the rear roller, and wherein the electric motor is operably connected with either the front roller or the rear roller.

5. The treadmill of claim 1, further comprising an adjustable support structure that is configured to raise and lower one of the front portion or rear portion of the treadmill to adjust an angle of the treadmill relative to the ground.

6. The treadmill of claim 5, wherein the adjustable support structure includes a pair of supports, each of which include a first leg and a second leg, and wherein each first and second leg is pivotally attached to the structure, wherein the first leg of each of the pair of supports includes a post which engages an adjustment slot which includes a plurality of receivers, and wherein by changing which of the receivers into which the post is engaged, the user is able to adjust the angle of the treadmill.

7. The treadmill of claim 5, wherein the adjustable support structure is coupled to the structure and contacts a surface on which the treadmill is positioned.

8. The treadmill of claim 1, wherein the structure lacks any front structure that connects the pair of side structures in front of the front roller.

9. The treadmill of claim 1, further comprising a remote control for remotely controlling operation of the treadmill.

10. A treadmill, comprising:

a structure for operation by a user in a seated position that includes:

a pair of side frames, each having a front portion and a rear portion;

a front roller rotatably mounted on the front portions of the pair of side frames;

a rear roller rotatably mounted on the rear portions of the pair of side frames such that the rear roller is disposed parallel to the front roller and is spaced apart from the front roller by a longitudinal distance that is 10 inches or greater, but less than 30 inches;

a belt that circumscribes the front roller and the rear roller;

an electric motor operably mounted on the structure, wherein the electric motor is positioned so that it is circumscribed by the belt;

wherein the pair of side frames has a greater height at the front portion than at the rear portion;

the structure lacking any front structure that connects to the pair of side frames in front of the front roller;

wherein a diameter of the front roller is larger than a diameter of the rear roller; and wherein the treadmill is configured to be positioned on a ground surface in front of the user while the user is seated in a chair such that the user is capable of walking their feet on the treadmill while remaining seated.

11. The treadmill of claim 10, wherein the longitudinal distance is between 14-28 inches.

12. The treadmill of claim 10, further comprising a support structure coupled to the structure and configured to create an angle relative to the ground for the treadmill.

13. The treadmill of claim 10, further comprising a remote control for remotely controlling operation of the treadmill.

14. The treadmill of claim 10, further comprising a bed between the front roller and the rear roller, and a force sensor operably positioned to sense a force applied to the bed.

15. A treadmill, the treadmill comprising:

a structure for operation by a user in a seated position having:

a front portion and a rear portion;

a front roller rotatably mounted on the front portion of the structure;

a rear roller rotatably mounted on the rear portion of the structure such that the rear roller is disposed parallel to the front roller and is spaced apart from the front roller by a longitudinal distance that is 10 inches or greater, but less than 30 inches; and a belt mounted around the front and rear rollers;

a bed between the front roller and the rear roller, and a force sensor operably positioned to sense a force applied to the bed; and a computer controller for controlling an electric motor of the treadmill, the computer controller being operably connected with the force sensor to disable the electric motor if the force applied to the bed exceeds a predetermined maximum weight, and indicates that the user is standing on the treadmill rather than operating the treadmill in the seated position.

* * * * *